US006820285B2

(12) United States Patent
Bataille et al.

(10) Patent No.: US 6,820,285 B2
(45) Date of Patent: Nov. 23, 2004

(54) HELMET COMPRISING RETRACTABLE VISORS FOR FAST DAY/NIGHT RECONFIGURATION

(75) Inventors: Alexandre Bataille, Bordeaux (FR); Guy Meyer, St Medard en Jalles (FR)

(73) Assignee: Thales, Paris (FR)

( * ) Notice: Subject to any disclaimer, the term of this patent is extended or adjusted under 35 U.S.C. 154(b) by 0 days.

(21) Appl. No.: 10/450,047

(22) PCT Filed: Dec. 11, 2001

(86) PCT No.: PCT/FR01/03925

§ 371 (c)(1),
(2), (4) Date: Jun. 10, 2003

(87) PCT Pub. No.: WO02/47503

PCT Pub. Date: Jun. 20, 2002

(65) Prior Publication Data

US 2004/0143888 A1 Jul. 29, 2004

(30) Foreign Application Priority Data

Dec. 12, 2000 (FR) ..... 00 16157

(51) Int. Cl.[7] ..... A42B 1/24
(52) U.S. Cl. ..... 2/422; 2/6.3; 2/6.7; 2/424
(58) Field of Search ..... 2/6.3, 6.2, 6.4, 2/6.5, 6.7, 424, 10, 422; 359/409, 815

(56) References Cited

U.S. PATENT DOCUMENTS 4,364,636 A * 12/1982 Ellis ..... 2/6.2
4,918,752 A * 4/1990 Briggs ..... 2/6.2
5,184,231 A * 2/1993 Ellis ..... 359/815
5,265,276 A * 11/1993 Kimberly, Jr. ..... 2/6.2
5,604,930 A * 2/1997 Petit et al. ..... 2/6.5
5,623,730 A * 4/1997 Baudou et al. ..... 2/6.2
5,646,785 A * 7/1997 Gilboa et al. ..... 2/6.3
5,742,937 A * 4/1998 Baudou et al. ..... 2/6.3
6,260,213 B1 * 7/2001 Eom et al. ..... 2/424
6,301,720 B1 * 10/2001 Bataille et al. ..... 2/422
2002/0148032 A1 * 10/2002 Basson et al. ..... 2/422

FOREIGN PATENT DOCUMENTS

DE 94 09 463 U 10/1995
DE 4417658 A1 * 11/1995 ..... A42B/3/04
EP 0 290 293 A 11/1988
FR 2 478 960 A 10/1981
FR 2 759 869 A 8/1998
WO 01 89332 A 11/2001

* cited by examiner

*Primary Examiner*—Rodney M. Lindsey
(74) *Attorney, Agent, or Firm*—Lowe Hauptman Gilman & Berner, LLP

(57) ABSTRACT

The invention relates to a helmet with retractable visors for fast day/night reconfiguration.

For that, the helmet (1) is designed at the articulations of the visors to allow the use of articulations that can be disassembled without tools. The day visor (15) is thus made modular and removable and is mounted on the helmet by a translational movement in a direction (F) allowing the upper part (16) to engage in a saggital guide rail of the helmet and allowing rotation axes of the helmet to engage in the articulation part of the lateral arms (8) of the visor, locking being effected by hand using a pivoting lever (8). For night missions, the day visor is removed and replaced with a night module mounted on the helmet using the same type of articulation.

The invention applies in particular to helmets for aircraft pilots, allowing unprepared ejection.

10 Claims, 5 Drawing Sheets

HELMET COMPRISING RETRACTABLE VISORS FOR FAST DAY/NIGHT RECONFIGURATION

The present invention relates to a helmet comprising retractable visors for fast day/night reconfiguration.

A helmet for an aircraft pilot, particularly the pilot of a combat airplane, is generally a multifunction affair equipped with visors. Such a helmet comprises a rigid shell which generally surrounds the top, rear and lateral parts of the wearer's skull. The helmet generally comprises visors through which the helmet wearer can see his environment; these visors are usually retractable toward the top of the skull and afford the face protection against various kinds of attack (wind, dust, light or strong illumination, etc.). For that, a standard helmet is generally provided with a dark visor arranged closest to the face and retractable up inside the helmet, to afford protection against strong illumination, particularly for day vision. Furthermore, for day use, a retractable clear visor mounted on the shell of the helmet on the outside and lockable in a folded-down position is provided. For night use, it is necessary to insert night vision equipment in front of the wearer's eyes. However, the bulk of such equipment then prevents it from being possible to lower the clear day visor.

One very important problem which arises with all helmets is that of the weight carried when the pilot has to eject or in the event of a violent impact (if the aircraft crashes for example. What happens during ejection is that it is absolutely essential for the pilot's face to be protected by a fold-down visor. Furthermore, the weight of the functional elements added to the helmet and the way in which they are positioned tend to impose forces which are dangerous to the pilot's neck in the event of strong accelerations, such as the acceleration involved in an ejection, and it is therefore necessary to avoid adding additional elements, particularly ones positioned away from the natural center of gravity of the pilot's bare head and neck.

One solution currently recommended in the event of pilot ejection is for the night vision equipment to be ejected then the clear day visor lowered before the pilot ejects. However, a significant disadvantage is that the ejection of the pilot needs to be prepared for. It might be possible to anticipate keeping the night vision equipment with a third clear visor arranged in front of it to protect the pilot's face in the event of ejection. That would allow for unprepared ejection. However, the mass added to the helmet and the offset of the center of gravity would then become prohibitive (5 to 10% would be added to the weight of the helmet with a significant lever arm with respect to the pilot's neck).

The anticipated solution is therefore to provide just two visors (one clear, one dark) for use whether by day or by night.

For that, the invention anticipates adapting the standard helmet to allow fast reconfiguration replacing a day visor which does not adversely affect the ergonomics of the standard helmet, by a night module incorporating night vision equipment and a clear visor in front of this equipment and lockable in the down position. This is achieved according to the invention using articulations between the visor or the night module and the helmet that can be disassembled without tools.

According to the invention, there is therefore provided a helmet comprising retractable visors for fast day/night reconfiguration, said helmet comprising a shell including a saggital guide rail with a central opening, characterized in that it comprises a retractable day visor or a night module incorporating night vision equipment and a retractable visor in front of this equipment, the day visor and the night module being interchangeable rapidly and without tools and comprising an upper central part collaborating with said guide rail and lateral arms each symmetrically equipped with an articulation to the shell of the helmet that can be disassembled without tools and in that each of said articulations about a common rotation axis comprises a first part secured to the shell, comprising at least one guide boss for guidance in a predetermined direction perpendicular to said rotation axis and a peripheral channel and a second part secured to the arm comprising at least one locking lever articulated in said second part to be immobilized in said channel.

This easy removal is made possible by virtue of a special articulation architecture.

According to this other aspect of the invention, there is therefore provided a helmet as defined hereinabove, characterized in that:

- said first part comprises a bearing and guide piece secured to the shell having at least one bearing face perpendicular to said axis which it surrounds and exhibiting said guide boss for guidance in said predetermined direction perpendicular to said rotation axis;
- said second part comprises at least:
  - an intermediate piece consisting of a washer equipped with a peripheral groove and with a slot extending from the center to the periphery of the intermediate piece, the respective shape and size of said slot and of said boss being tailored to one another so that when the intermediate piece comes to bear against said bearing surface of the bearing piece, the boss is engaged in the slot and prevents the intermediate piece from rotating;
  - said lever of semicircular overall shape pivoting about a pivot arranged in the groove of the intermediate piece and on the opposite side to the opening of the slot, said boss comprising an outer peripheral channel which can be aligned with the groove of the intermediate piece when the latter is bearing against the bearing piece so that the internal edge of the lever, in the locked position, becomes inserted in the facing part of the groove and in the channel of the boss;
  - means of fixing the intermediate piece on said arm allowing these pieces a limited relative rotation about the rotation axis;

and in that said predetermined direction of each of the articulations lies in a plane containing said rotation axes and the center of the central opening of the rail.

By nature of these features it is thus possible quickly and without tools to reconfigure the helmet, switching from a day configuration with a clear day visor to a night configuration with a night module and lockable clear visor, in all cases allowing the pilot to eject without any preparation while at the same time maintaining common day use without any adverse effects on ergonomics.

The invention will be better understood and other features and advantages will become apparent from the description which follows and from the appended drawings in which.

As already explained hereinabove, the object of the invention is to be able to use a standard helmet with night vision equipment while at the same time allowing unprepared ejection without any adverse effect on the ergonomics in the day configuration. As was also already mentioned, in the event of ejection, it is essential for the helmet wearer's face to be protected by a visor.

In a standard helmet, the clear day visor, arranged in front of the helmet with respect to the tinted visor, is far too close to the pilot's face to allow night vision equipment to be inserted between the face and the day visor. That being the case, the solutions used or conceivable may consist either in replacing the clear day visor with another visor further away from the face with the disadvantage of adversely affecting the ergonomics of the helmet in the day configuration, or in using a third clear visor compatible with the wearing of the night vision equipment, but with the disadvantage of excessive carried mass, or finally, in providing automatic ejection of some of the helmet-mounted equipment, something which is very difficult to optimize.

To solve this problem, the invention has conceived of the idea of adapting the standard helmet to allow fast day/night reconfiguration by toolless replacement of the clear visor of the day configuration with a night module incorporating a retractable visor, so that there are never any more than two visors (one clear and one dark) both by day and by night. This minimizes the carried mass but still affords visor protection to allow the pilot to eject without preparation by day or by night.

Figure 1:
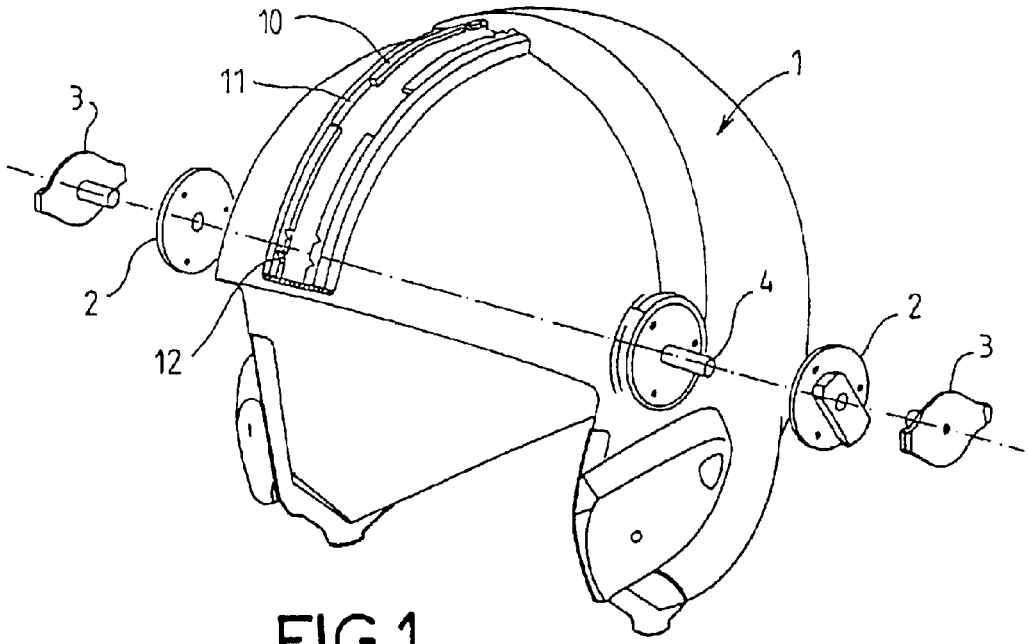
FIG. 1 is a view of a helmet designed for fast reconfiguration.

FIG. 1 is a view of a helmet adapted to give it the ability to alternate rapidly and without tools between the day configuration and the night configuration. To do that, the outer (clear) day visor and the lateral mechanisms of this visor are removed, leaving on the shell 1 of the helmet only the rotation axes 4 and the control knobs 3 for the tinted inner visor, the control mechanism of which will not be described further because it is unchanged. A first part of the removable articulations arranged symmetrically on each side of the helmet comprises, apart from the rotation axis 4, a bearing and guidance piece 2 attached about the axis 4 and screwed onto the shell 1. In position, this piece 2 comprises a bearing face facing outward and perpendicular to the rotation axis and comprising a guide boss, as will be seen later on. The helmet is also equipped with a saggital guide rail 10 with a central opening 11 and teeth 12 for locking the equipment in the down position.

Figure 2B:
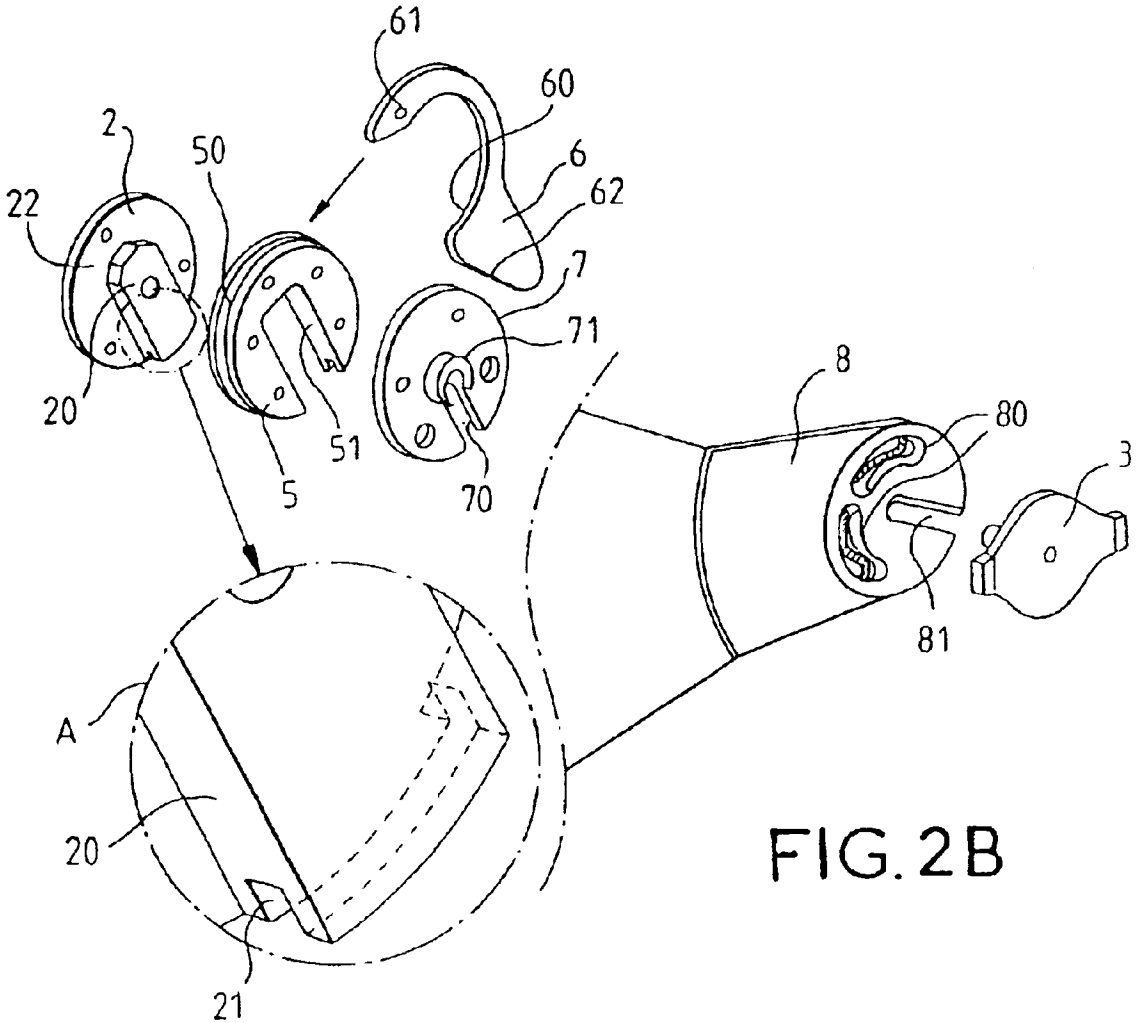
FIGS. 2A and 2B depict, in section and as an exploded view, the mechanism of an articulation that can be disassembled without tools for a helmet according to the invention.
Figure 2A:
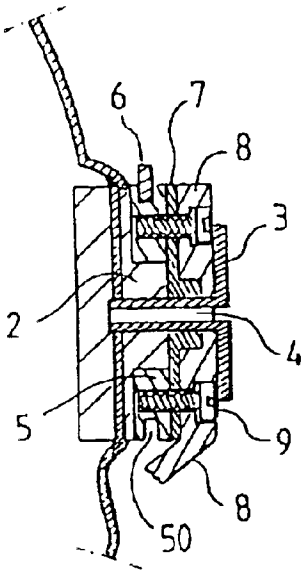

FIGS. 2A and 2B depict an articulation that can be disassembled without tools for articulating a lateral arm 8 of a day visor or of a night module to the shell 1 of the helmet. As can be seen in FIG. 2B, the piece 2 on its bearing face 22 bears a guide boss 20 extending in a predetermined direction perpendicular to the rotation axis 4 (FIG. 1) and lying in a plane containing the rotation axes and the center of the central opening 11 of the rail 10.

The articulation comprises a second part secured to the arm 8 and comprising an intermediate piece 5, an insert piece 7 and a locking lever 6. The intermediate piece 5 in the form of a washer is equipped with a peripheral groove 50 and with a slot 51 extending from the center to the periphery of the intermediate piece. This slot has a size and shape tailored to those of the boss 20 so that when the piece 5 comes to bear against the bearing surface 22, the boss 20 is engaged in the slot 51 and prevents the piece 5 from rotating. This piece is equipped with a lever 6 of semicircular overall shape pivoting about a pivot 61 arranged in the groove 50 on the opposite side to the slot 51. The boss 20 comprises, as can be seen in detail A of FIG. 2B, an outer peripheral channel 21 which becomes aligned with the groove 50 of the piece 5 when the latter is bearing against the bearing piece 2. Thus, the internal edge 60 of the lever 6, in the locked position, becomes inserted in the facing part of the groove 50 and in the channel 21 of the boss.

The insert piece 7 comprises a slot 70 parallel to the direction of the slot 51 of the intermediate piece 5 extending from the center of the piece 7 to its periphery with dimensions such that it allows the passage of the rotation axis 4 and the centering on this axis in the articulation locked position. The insert piece 7 also comprises a centered pivot 71 engaging in a corresponding housing of the arm 8 to allow and guide limited rotation of the arm 8 with respect to the pieces 5 and 7. Finally, the arm 8 comprises a slot 81 with the same dimensions as the slot 70 and aligned with the latter in the unlocked position.

Fixing means secure the pieces 5 and 7 to the arm 8 while at the same time allowing limited rotation of the arm 8 with respect to the pieces 5, 7. For that, there are provided for example screws 9 screwed onto the intermediate piece 5 through the piece 7 and oblong holes 80 pierced in the arm 8, in the shape of arcs of circles centered on the rotation axis 4 in the locked position.

Figure 3:
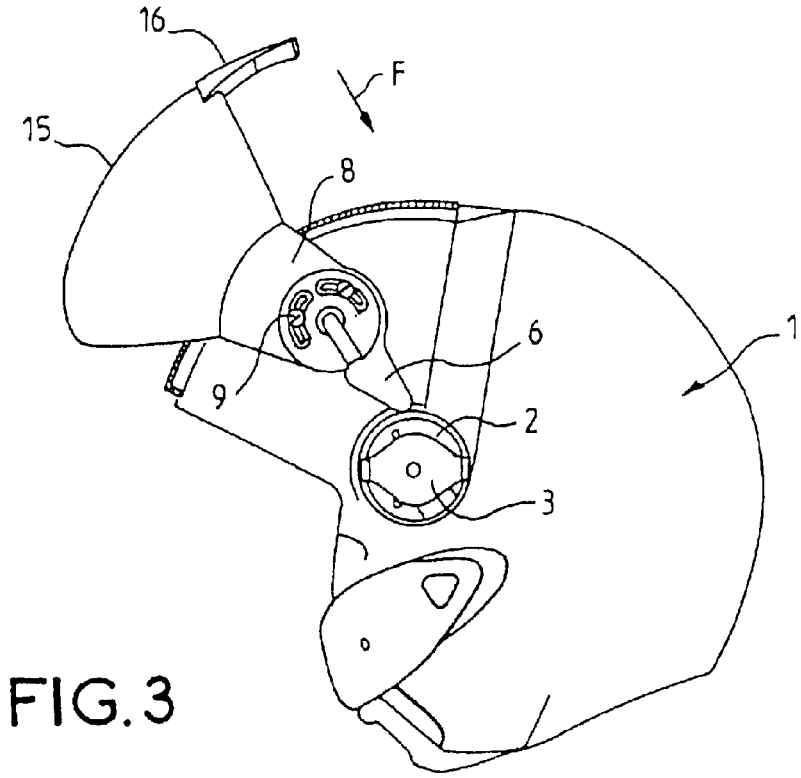
FIG. 3 shows a view of the fitting of a day visor on the helmet according to the invention.

FIG. 2B depicts, in section, all these pieces in the locked position. Having described these articulations, FIG. 3 shows the fitting of a day visor 15 on the helmet. The movement of the visor 15 is effected in the direction F parallel to the predetermined direction of the boss 20. The upper mechanism 16 of the visor is slipped into the central opening of the rail at the same time as the piece 5 secured to the visor is guided over the boss of the piece 2 secured to the helmet. The slots 51, 70 and 81 allow the rotation axis 4 to pass. Of course, on each lateral arm of the visor there is an identical disassemblable articulation, these articulations being symmetric with respect to the saggital plane of the helmet.

Figure 4:
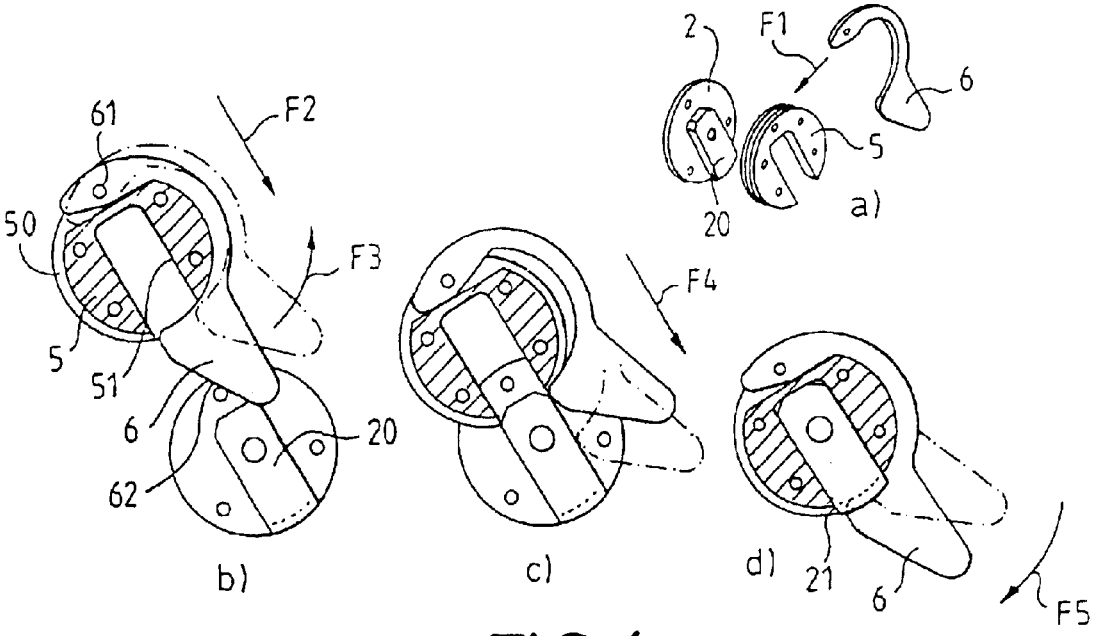
FIG. 4 illustrates the sequence of locking the articulation of FIGS. 2A and 2B.

FIG. 4 illustrates the sequence of locking an articulation, only the pieces 2 and 5 and the lever 6 being depicted, the piece 5 being in section in steps b) to d).

The arrow F1 in step a) shows only how the lever 6 was initially assembled with the piece 5. Step d) shows the start of the fitting of the visor onto the helmet in the direction F2. The end of the lever 6 has an inclined plane 62 which comes into contact with the boss 20 and pushes the lever 6 back toward the position shown in dotted line in the direction of the arrow F3. Then (step c)), the slot 51 begins to engage over the boss 20 in the direction of movement F4. Finally, in step d), when full engagement is achieved, locking takes place, by acting on the lever 6 in the direction of the arrow F5.

Figure 5:
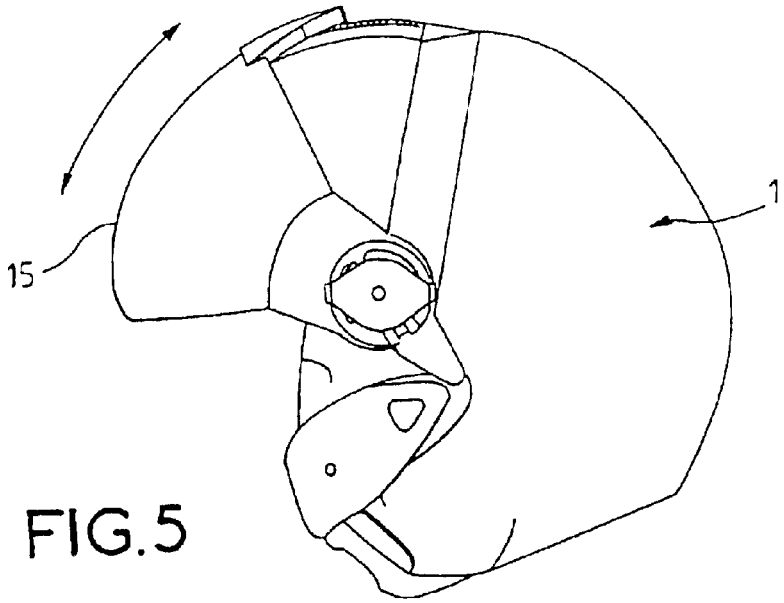
FIG. 5 is a view of the helmet fitted with its day visor according to the invention.

FIG. 5 shows the adapted helmet with its clear day visor fitted. The visor 15 therefore occupies the same position as a standard day visor and can be manipulated in the central part and locked in the down position on the teeth 12 (FIG. 1) of the rail. It can therefore be seen that the visor can very easily be fitted or removed without tools. Removal is performed by raising the visor to the level of the central opening of the rail and manually unlocking the two levers 6. During the upward movement of the visor, the slot 81 of the arms 8 has come back into coincidence with the slots 51 and 70 to release the rotation axes 4.

Figure 6:
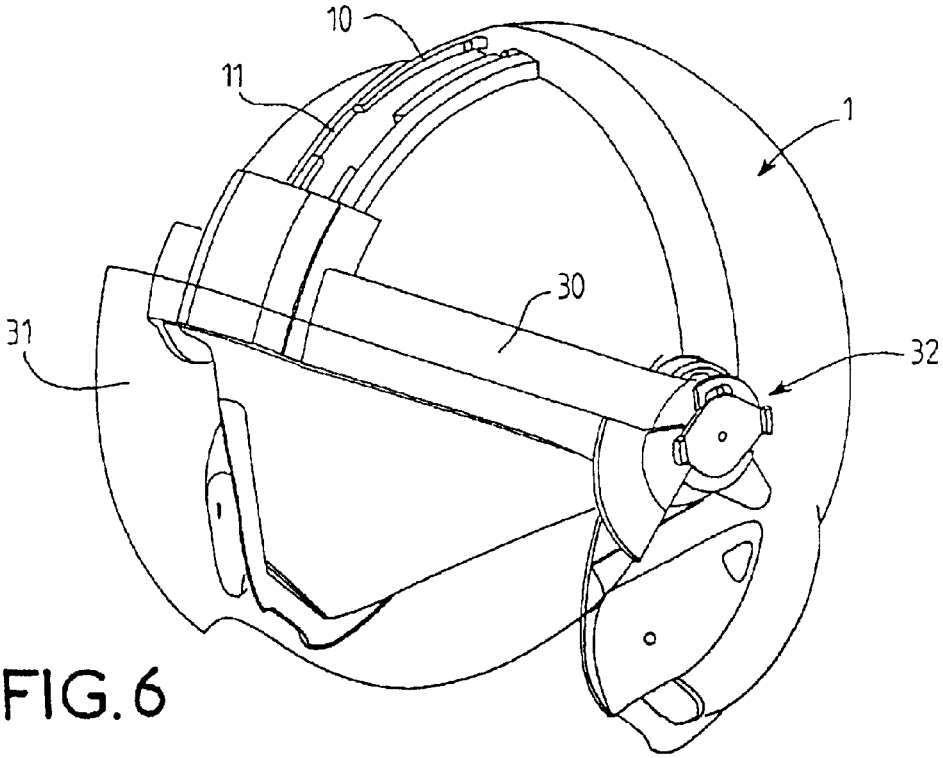
FIG. 6 is a view of the night configuration for the helmet of the invention.

In the night configuration, the day visor is removed and a night module mounted on the helmet with identical articulations on the lateral arms is used. FIG. 6 shows the night configuration architecture. The night module comprises a crown piece 30 with its lateral arm fixed to the helmet 1 by articulations 32 identical to the ones already described. The crown piece is equipped with the same upper locking mechanism as the visor, collaborating with the rail 10. The clear visor 31 supported by the crown piece is further away from the helmet wearer's face so that night vision equipment can be locked in front.

Figure 7:
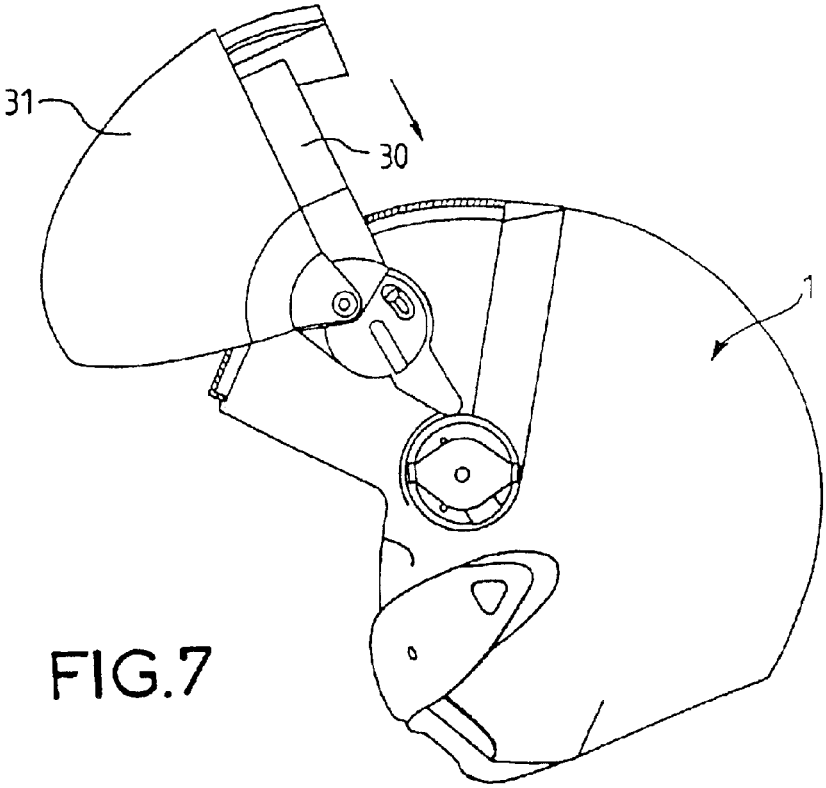
FIG. 7 shows a view of the fitting of the night module onto the helmet.

The crown piece with the visor is fitted onto the helmet as shown in FIG. 7. This is done in practically the same way as with the clear day visor.

Figure 8:
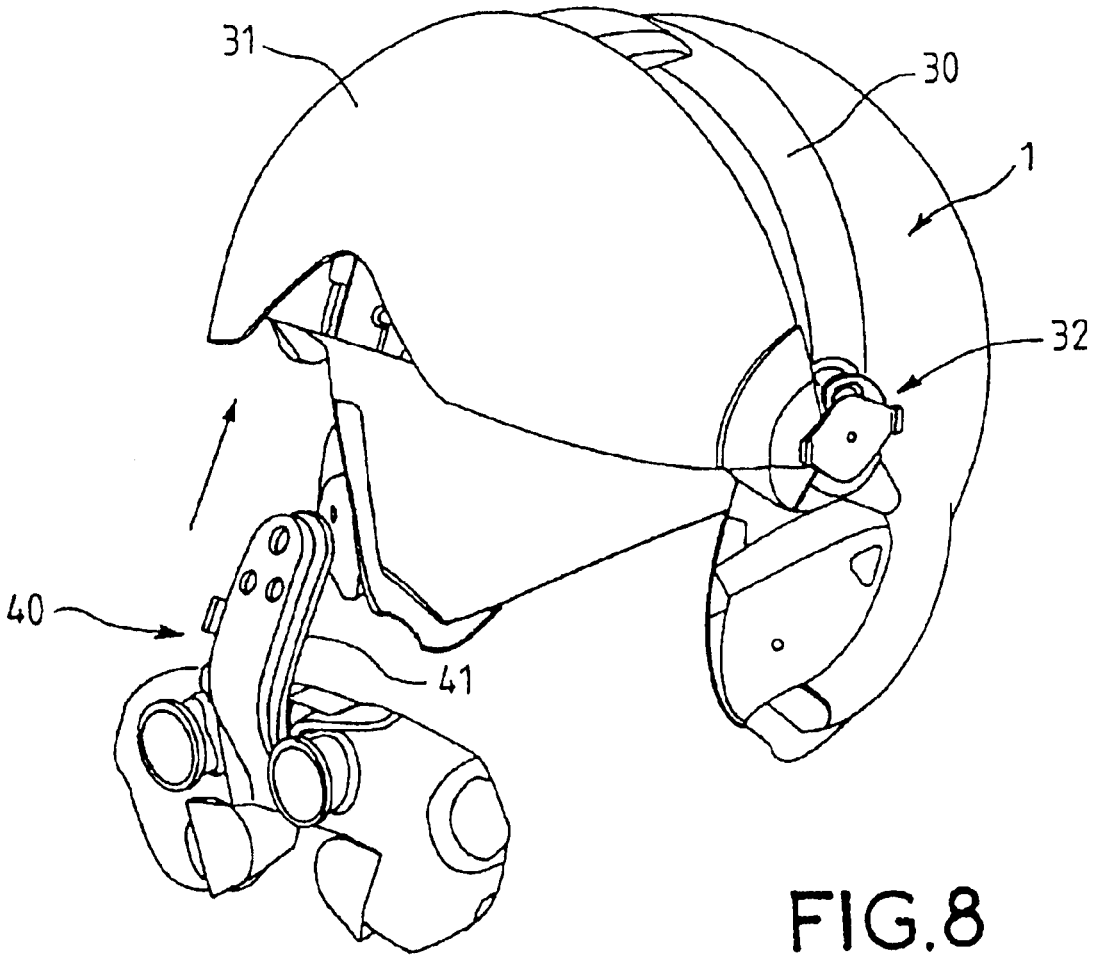
FIG. 8 illustrates the mounting of the night vision equipment in respect of the helmet according to the invention.

The night vision equipment is then received as depicted in FIG. 8. The visor 31 and the crown piece 30 are in the raised position where they are held simply by friction on the rotation axes of the lateral articulations. The night vision equipment 40 is then offered up and, via its piece 41, for example in the shape of a dovetail, locks onto the helmet 1. Once fitted, this equipment lends the visor 31 the possibility of being folded down in front of it and of locking in the down position in the teeth of the rail, something which is of primordial importance in order to guarantee that the visor will hold during an ejection, which therefore does not require preparation.

Of course, the exemplary embodiments described do not restrict the invention. As can be seen, the invention makes it possible to maintain in day configuration, a bulk and ergonomics which are identical to those of a standard helmet even though the clear day visor has become modular.

What is claimed is:

1. A helmet comprising retractable visors for fast day/night reconfiguration, comprising:

a shell including a saggital guide rail with a central opening:

a night vision module and a retractable visor in front of the night vision module, a day visor and the night module being interchangeable rapidly and without tools and comprising an upper central part collaborating with said guide rail and lateral arms, each symmetrically equipped with an articulation to the shell of the helmet that can be disassembled without tools and in that each of said articulations about a common rotation axis comprises a first part secured to the shell, comprising at least one guide boss for guidance in a predetermined direction perpendicular to said rotation axis and an outer peripheral channel and a second part secured to the arm comprising at least one locking lever articulated in said second part to be immobilized in said channel.

2. The helmet as claimed in claim 1, wherein:

said first part comprises a bearing and guide piece secured to the shell having at least one bearing face perpendicular to said axis which it surrounds and said guide boss provides for guidance in said predetermined direction perpendicular to said rotation axis;

said second part comprises:

an intermediate piece including a washer equipped with a peripheral groove and with a slot extending from the center to the periphery of the intermediate piece, the respective shape and size of said slot and of said boss being tailored to one another so that when the intermediate piece comes to bear against said bearing surface of the bearing piece, the boss is engaged in the slot and prevents the intermediate piece from rotating;

said lever of semicircular overall shape pivoting about a pivot arranged in the groove of the intermediate piece and on the opposite side to the opening of the slot, said outer peripheral channel can be aligned with the groove of the intermediate piece when the latter is bearing against the bearing piece so that the internal edge of the lever, in the locked position, becomes inserted in the facing part of the groove and in the channel of the boss;

means of fixing the intermediate piece on said arm allowing these pieces a limited relative rotation about the rotation axis;

and in that said predetermined direction of each of the articulations lies in a plane containing said rotation axes and the center of the central opening of the rail.

3. The helmet as claimed in claim 2, wherein the second part further comprises an insert piece arranged between said intermediate piece and said arm and fixed to said intermediate piece to center said limited rotation about said rotation axis.

4. The helmet as claimed in claim 2, wherein said fixing means includes screws screwed onto the intermediate piece through oblong holes pierced in said arm in the shape of arcs of circles centered on said rotation axis in the locked position.

5. The helmet as claimed in claim 4, wherein the insert piece has a slot parallel to the direction of the slot of the intermediate piece and extending from the center of the insert piece to its periphery with dimensions such that it allows the passage of said rotation axis and centering on said rotation axis in the articulation locked position, and a centered pivot engaging in a corresponding housing in the arm to allow and guide its limited rotation, and in that said arm has a slot of roughly the same size as the slot and aligned with the latter in the unlocked position.

6. The helmet as claimed in claim 5, wherein the slots of the intermediate piece, of the insert piece and of the arm are aligned and parallel to said predetermined direction when said visor or said night module is being mounted and removed, the fitting or removal movement being effected parallel to said predetermined direction.

7. The helmet as claimed in claim 6, wherein said lever of each articulation comprises, at its opposite end to the pivot, an inclined plane such that, while the visor is being fitted, it collaborates with the boss to automatically move the lever away from its locked position and allow this boss and the rotation axis to engage into the bottom of the slots of the intermediate piece, of the insert piece and of the arm of the visor.

8. The helmet as claimed in claim 1, wherein the night module comprises a crown piece supporting a clear visor, arranged further forward on the helmet than the day visor so as to allow night vision equipment to be fitted between the helmet wearer's face and the visor, and bearing the second parts of said articulations.

9. The helmet as claimed in claim 3, wherein said fixing means includes screws screwed onto the intermediate piece through oblong holes pierced in said arm in the shape of arcs of circles centered on said rotation axis in the locked position.

10. The helmet as claimed in claim 7, wherein the night module comprises a crown piece supporting a clear visor, arranged further forward on the helmet than the day visor so as to allow night vision equipment to be fitted between the helmet wearer's face and the visor, and bearing the second parts of said articulations.

* * * * *